US007905685B2

(12) United States Patent
Heselden

(10) Patent No.: US 7,905,685 B2
(45) **Date of Patent: *Mar. 15, 2011**

(54) GABION DEPLOYMENT

(75) Inventor: James Heselden, Leeds (GB)

(73) Assignee: Hesco Bastion Limited, Leeds, Yorshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 12/443,245

(22) PCT Filed: Dec. 17, 2007

(86) PCT No.: PCT/GB2007/050760

§ 371 (c)(1),
(2), (4) Date: May 1, 2009

(87) PCT Pub. No.: WO2008/081177

PCT Pub. Date: Jul. 10, 2008

(65) Prior Publication Data

US 2010/0008726 A1 Jan. 14, 2010

(30) Foreign Application Priority Data

Jan. 2, 2007 (GB) ..... 0700001.1

(51) Int. Cl.
*E02B 3/06* (2006.01)

(52) U.S. Cl. ..... 405/284; 405/258.1; 405/21; 206/494

(58) Field of Classification Search ..... 405/15, 405/16, 19, 21, 30, 32, 284, 287, 287.1; 206/494; 220/694; 414/467, 812; 221/305; 248/317, 248/320, 342, 343; 224/496, 498, 542; 411/2, 411/39, 43, 476

See application file for complete search history.

(56) References Cited

U.S. PATENT DOCUMENTS 5,472,297 A 12/1995 Heselden (Continued)

FOREIGN PATENT DOCUMENTS

| | | | |
|---|---|---|---|
| EP | 0816572 | A2 | 1/1998 |
| EP | 0735198 | A | 7/2000 |
| GB | 2423107 | A | 8/2006 |
| JP | 57146835 | A | 9/1982 |

(Continued)

OTHER PUBLICATIONS

GB Search Report (GB Application No. GB0700001.1); International Search Report (International Application No. PCT/GB2007/050760; filed Dec. 17, 2007).

*Primary Examiner* — David J Bagnell
*Assistant Examiner* — Benjamin Fiorello
(74) *Attorney, Agent, or Firm* — Ping Wang; Andrews Kurth, LLP

(57) ABSTRACT

A gabion deployment system comprising: a container (30) for retaining a gabion (22) and a gabion (22) of the folding type comprising hingedly attached, connected side walls (16 & 18) and cross-members (12) such that it can be folded for storage and deployed for use; a retaining means (50) associated with the container (30) for retaining the gabion (20) in the container; and at least one releasable attaching, connecting or retentive engaging means (66) for attaching, connecting or retentively engaging at least one part of the gabion (22) to the retaining means (50); wherein the at least one releasable attaching, connecting or retentively engaging means (66) is adapted to attach, connect or retentively engage a part of the gabion (22) to the retaining means (50) when the gabion (22) is folded but to release the gabion (22) from the retaining means (50) when the gabion (22) is deployed.

20 Claims, 6 Drawing Sheets

U.S. PATENT DOCUMENTS

| | | | | |
|---|---|---|---|---|
| 5,636,938 | A | 6/1997 | Ragazzo | |
| 5,647,695 | A * | 7/1997 | Hilfiker et al. | 405/284 |
| 6,550,491 | B1 * | 4/2003 | Bixler et al. | 135/145 |
| 2006/0275084 | A1 | 12/2006 | Harbeck | |

FOREIGN PATENT DOCUMENTS

| | | | |
|---|---|---|---|
| WO | 9012160 | A1 | 10/1990 |
| WO | 0040810 | A1 | 7/2000 |

* cited by examiner

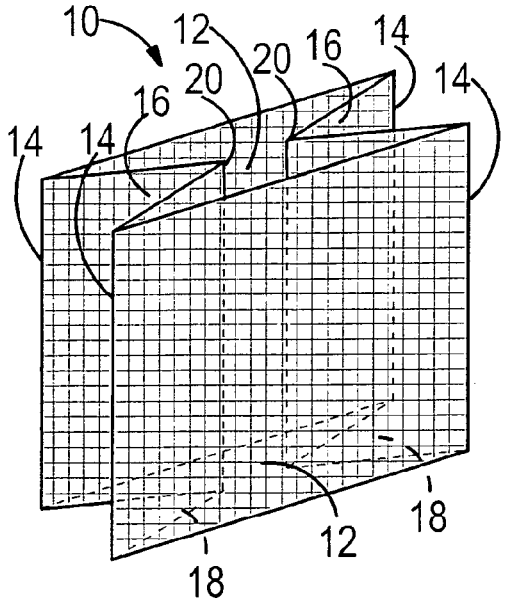
FIG.1.
(PRIOR ART)
FIG.2.
(PRIOR ART)
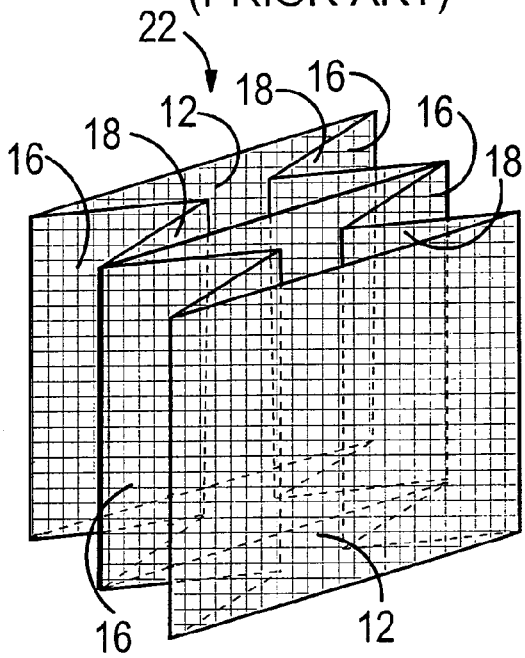
FIG.3.
(PRIOR ART)
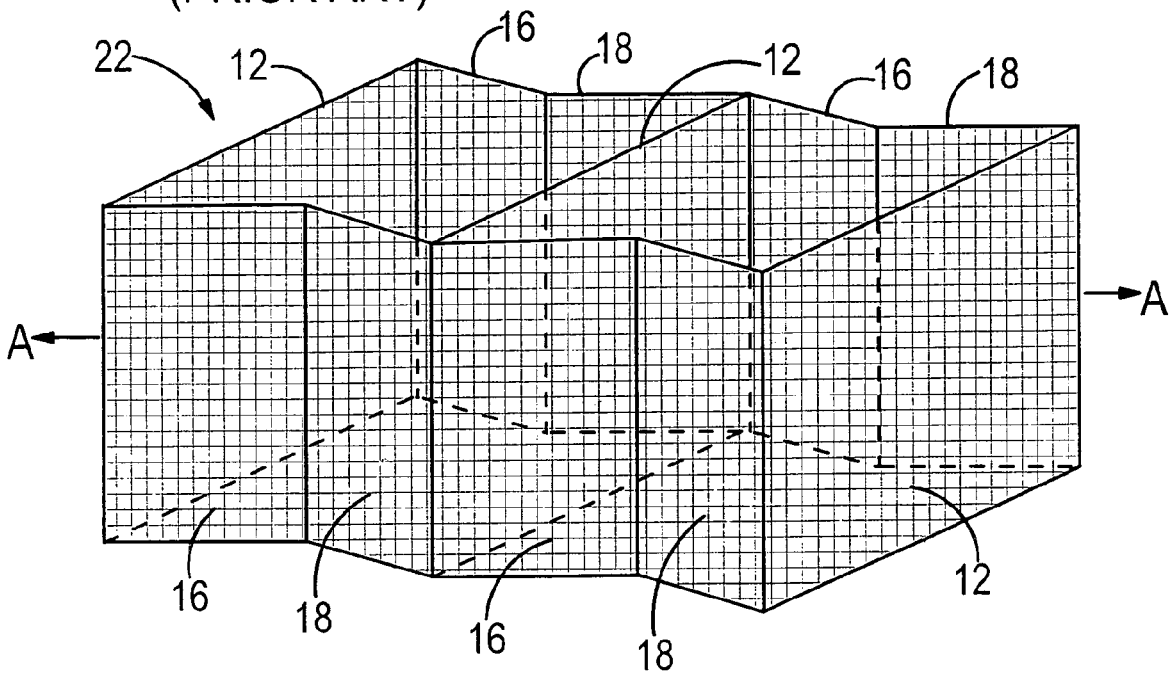

GABION DEPLOYMENT

FIELD

This invention relates to gabion deployment and in particular to improvements in and relating to storing and/or deploying gabions.

BACKGROUND

Gabions are generally structures of the type which comprise side wall panels, end panels and partition panels which connect the wall panels, and all the panels are usually rectangular and may be pivotally attached, connected together so that the structure can be moved between an expanded (or deployed) condition for use and a collapsed (or folded) condition for storage and transport. In the deployed condition, the structure is elongated and the panels define a row of cavities extending in the length direction of the structure, each cavity being defined by side panels and partition panels, apart from the end cavities which are defined by side panels, partition panels and end panels. These cavities can be filled with ballast or building materials so that the structure turns into a robust wall which can be used for defences for flooding, for military equipment and personnel, and for shoring of hillsides and river banks and the like, or simply as a property or other boundary. They can be used side-by-side, end-to-end or in superimposed relationship, depending upon the use to which they are to be put.

In the folded condition, the structure is basically flat and the partition and end panels lie in parallel planes, whilst the side panels of each side are folded one relative to another in zig-zag or concertina fashion, so that the plan footprint of the collapsed structure is rectangular.

It is to be mentioned that when reference is made to "rectangular" herein, square, which is one form of rectangle, is specifically to be included.

An example of a structure of the type set forth is illustrated in European Patent No. 0 466 726 B1 in FIGS. 1 and 2 thereof, and an accompanying description is also included in that Patent.

Gabions have been used throughout the world for many different uses, and often in situations where rapid deployment (to prevent flooding, or protect against hostile forces, for example) is necessary. One advantage of the pivotally attached, connected multi-compartmental gabions described in EP-B-0466726 is that they can be easily and quickly erected, and can be filled with readily available and inexpensive material, especially in those embodiments, as described in said European Patent, where the panels are of mesh and have a lining material of geo textile to prevent particles of the filling material from falling through the holes of the mesh. This mesh and lining material construction is the preferred form for the present invention, but the invention is not limited to this particular form.

Heretofore, gabions have been supplied on pallets and in stacks, often wrapped in shrink wrap plastics material. Whilst this has been satisfactory and will we believe continue to be satisfactory especially for smaller sizes of gabion, with the larger gabions, the removal of the shrink wrapping, and the removal of the gabion from the pallet takes time, and in emergency situations, time is of the essence, and the more time which can be saved in erecting defence walls, the better.

SUMMARY

This invention seeks to achieve an improvement in this area, and to provide a means whereby the erection of gabions from the collapsed folded to the deployed condition can be achieved quickly and efficiently without the disadvantages of the present methods.

Accordingly, a first aspect of the present invention provides a container suitable for storing a folded gabion and from which the gabion can be deployed, the container comprising a base, at least one side wall and a roof, the container having a retaining means disposed therein in, on or to which a folded gabion can be releasably attached, connected or retentively engaged by way of at least one releasable attaching, connecting or retentive engaging means; wherein the at least one releasable attaching, connecting or retentive engaging means is adapted to attach, connect or retentively engage a part of the gabion to the retaining means when the gabion is folded but to release the gabion from the retaining means when the gabion is deployed.

A Second aspect of the invention provides a gabion of the type comprising: hingedly attached, connected sidewalls and cross-members such that it can be folded for storage and deployed for use; and at least one releasable attaching, connecting or retentive engaging the gabion to a retaining means; wherein the at least one realeasably attaching, connecting or retentive engaging means is adapted to attach, connect or retentively engage a part of the gabion to the retaining means when the gabion is folded but to release the gabion from the retaining means when the gabion is deployed.

A third aspect of the invention provides a gabion deployment system comprising: a container for retaining a gabion and a gabion of the folding type comprising hingedly attached, connected sidewalls and cross-members such that it can be folded for storage and deployed for use; a retaining means associated with the container for retaining the gabion in the container; and at least one releasable attaching, connecting or retentive engaging means for attaching, connecting or retentive engaging at least one part of the gabion to the retaining means; wherein the at least one releasable attaching, connecting or retentive engaging means is adapted to attach, connect or retentively engage a part of the gabion to the retaining means when the gabion is folded but to release the gabion from the retaining means when the gabion is deployed.

BRIEF DESCRIPTION OF THE DRAWINGS

FIG. 1 shows a schematic view of a prior art single unit gabion.

FIG. 2 shows a schematic view of a prior art multiple unit gabion in a folded configuration.

FIG. 3 shows a schematic view of a prior art multiple unit gabion in a deployed configuration.

DETAILED DESCRIPTION

Figure 4:
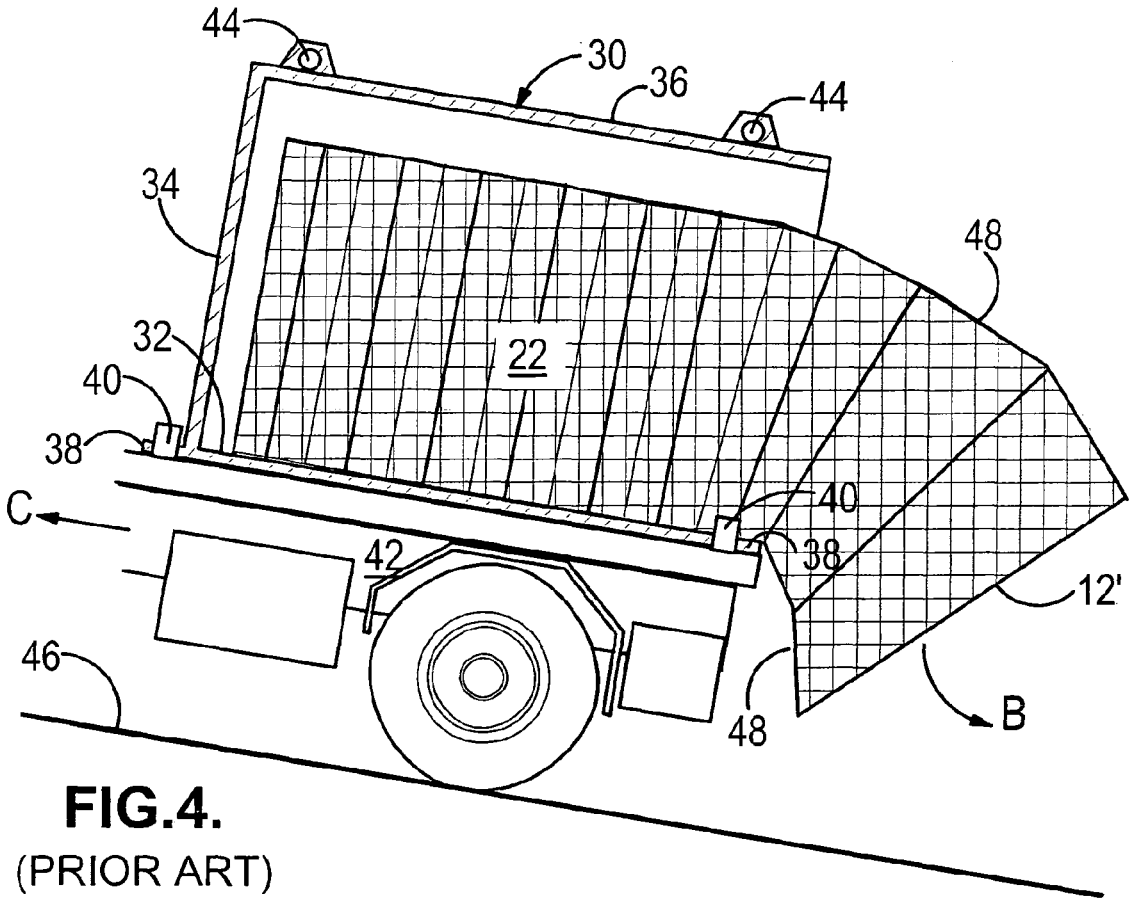
FIG.4. (PRIOR ART)
FIG. 4 shows a schematic prior art container gabion deployment system.

The invention seeks to achieve an improvement in this area, and to provide a means whereby the erection of gabions from the collapsed folded to the deployed condition can be achieved quickly and efficiently without the disadvantages of the present methods.

Accordingly, a first aspect of the invention provides a container suitable for storing a folded gabion and from which the gabion can be deployed, the container comprising: a base, at least one side wall and a roof, the container having a retaining means disposed therein in, on or to which a folded gabion can be releasably attached, connected or retentively engaged by way of at least one releasable attaching, connecting or retentive engaging means; wherein the at least one releasable attaching, connecting or retentive engaging means is adapted to attach, connect or retentively engage a part of the gabion to the retaining means when the gabion is folded but to release the gabion from the retaining means when the gabion is deployed.

A second aspect of the invention provides a gabion of the type comprising: hingedly attached, connected sidewalls and cross-members such that it can be folded for storage and deployed for use; and at least one releasable attaching, connecting or retentive engaging means suitable for attaching, connecting or retentive engaging the gabion to a retaining means; wherein the at least one releasable attaching, connecting or retentive engaging means is adapted to attach, connect or retentively engage a part of the gabion to the retaining means when the gabion is folded but to release the gabion from the retaining means when the gabion is deployed.

A third aspect of the invention provides a gabion deployment system comprising: a container for retaining a gabion and a gabion of the folding type comprising hingedly attached, connected sidewalls and cross-members such that it can be folded for storage and deployed for use; a retaining means associated with the container for retaining the gabion in the container; and at least one releasable attaching, connecting or retentive engaging means for attaching, connecting or retentive engaging at least one part of the gabion to the retaining means; wherein the at least one releasable attaching, connecting or retentive engaging means is adapted to attach, connect or retentively engage a part of the gabion to the retaining means when the gabion is folded but to release the gabion from the retaining means when the gabion is deployed.

The container can be of any suitable type, although it is envisaged that it will comprise a base, a plurality of side walls, a roof defining a cavity within which a folded gabion can be stored. Preferably, the container has a closable opening, e.g., one or more doors. The doors, where provided, are preferably lockable. The container is preferably manufactured of tough and/or strong and/or durable materials (e.g., metal or plastics). A preferred embodiment of the container has external formations thereon that enable it to be secured to surfaces, such as protrusions or apertures that are mutually engageable with corresponding apertures or protrusions of the surface, respectively. Formations may also be provided on the container to enable it to be hoisted and/or manoeuvred using a crane or other plant.

A most preferred embodiment sees the container being of a type suitable for loading onto a ship and/or vehicular trailer.

The roof of the container may be selected to have a retaining means disposed on the intended underside thereof to which a folded gabion can be attached, connected or retentively engaged. Alternatively, each side wall of the container may be selected to have a retaining means disposed on the intended inside thereof to which a folded gabion can be attached, connected or retentively engaged. Alternatively, or as well, the base of the container may be selected to have a retaining means disposed on the intended upside thereof to which a folded gabion can be attached, connected or retentively engaged. Preferably, however, the container is provided with the said retaining means in its roof and/or in the upper section of its side wall(s). The retaining means may comprise hooks or eyes or any other suitable form of mechanical restraint. Preferably, however, the retaining means comprises an elongate member, such as a bar or cable, to which parts of the gabion can be slidably attached, connected or retentively engaged. The retaining means may extend the entire length of the container. Additionally, the retaining means may be adapted to retractably extend beyond a periphery of the container (i.e., out through a door or opening therein) such that a part of the gabion can be retained whilst outside the container.

In one particularly preferred embodiment, the retaining means comprises a series of protuberances, which may be tooth-like, a gap between two protuberances accommodating in use of the stored gabion the edge section of one or more folded compartments of the multicompartmental gabion. The material of the protuberances may be selected to have a somewhat elastic characteristic so that on the application of a towing force for example to remove the folded gabion from the container, the protuberances are able to yield sufficiently to release the edge section from the gap. It is envisaged that, for example, when a multicompartmental gabion comprises ten compartments, the folded gabion will be stored/shipped in a container provided with ten protuberances, a first protuberance being situated between the entrance of the container and the first gabion compartment, a second protuberance being situated between first and second gabion compartments, with the edge section of the first gabion compartment extending into the gap between the first and second protuberances, a third protuberance being situated between the second and third gabion compartments, with the edge section of the second gabion compartment extending into the gap between the second and third protuberances, and so on, until a tenth protuberance is situated between the ninth and tenth gabion compartments, with the edge section of the ninth gabion compartment extending into the gap between the ninth and tenth protuberances. However, it should be emphasised that this is by way of example only, and it may not be necessary to provide as many protuberances as there are gabion compartments, it being satisfactory for example in some cases to restrain only the first or first few gabion compartments. It may also be possible in some cases to accommodate more than one (two, or three, for example) folded gabion compartment edge sections between a pair of protuberances.

In a particularly preferred version of this last embodiment, the protuberances may themselves be attached, connected together by means of a guide line or rod (such as a wire for example) which serves while attached, connected to restrain the protuberances in a substantially non-yielding orientation (by which is preferably meant sufficiently non-yielding so as not to release a folded gabion compartment edge section until removal of the guide line or rod). In this embodiment, only when the guide line is removed from a protuberance can the protuberance in question then yield to release a folded gabion compartment edge section. When the gabion is to be shipped or stored, the guide line is retained in place. When the gabion is to be deployed, the guide line is first removed, or is removed simultaneously or sequentially on deployment. The guide line may additionally be operatively attached, connected to the folded gabion itself. In one embodiment the guide line may be passed through the protuberances (themselves provided with suitable orifices or connecting means for the purpose) towards the front (non-entrance) end of the container, around a pulley and then threaded back towards the back (entrance) end of the container through the folded gabion (or through suitable orifices or connecting means provided for the purpose) and secured to the gabion at or towards the gabion first compartment situated at or towards the back (entrance) end of the container. By this mechanism the guide line may be sequentially removed from the protuberances (beginning with the first, back end, protuberance) when the gabion is removed from the container.

Thus, one embodiment of the invention provides a container suitable for storing a folded gabion and from which the gabion can be deployed, the container comprising a base, at least one side wall and a roof, the container having a retaining means disposed therein in, on or to which a folded gabion can be releasably attached, connected or retentively engaged by way of at least one releasable attaching, connecting or retentive engaging means; wherein the at least one releasable attaching, connecting or retentive engaging means is adapted to attach, connect or retentively engage a part of the gabion to the retaining means when the gabion is folded but to release the gabion from the retaining means when the gabion is deployed, wherein the retaining means comprises a series of protuberances and the releasable attaching, connecting or retentive engaging means comprises folded gabion compartment edge sections.

It will be appreciated that the protuberances may be provided on any one (or more) of the roof, floor or side wall(s) of the container. Preferably however, they are provided in the roof or in an upper section of the side wall(s).

Alternative mechanisms of releasable engagement wherein the gabion on deployment is subjected to a camming action by the retaining means may also be envisaged.

The retaining means may in certain embodiments comprise a comb-like structure, with a first comb tine or comb tine pair retentively engaging a first folded gabion compartment and a second comb tine or comb tine pair retentively engaging a second gabion compartment.

The at least one releasable attaching, connecting or retentive engaging means can be of any suitable type. It is anticipated that suitable releasable attaching, connecting or retentive engaging means may comprise, amongst others: a folded gabion compartment edge section; a frangible loop or ring; a frangible part of the gabion; a deformable, helical member; a releasable line; and a clip.

Where the releasable attaching, connecting or retentive engaging means is frangible, a point of weakness, such as a notch or groove may be provided to encourage the attaching, connecting or retentive engaging means to break at a predetermined position and/or load.

Any suitable type of clip may be used, such as a karabiner-type clip or a sprung-cam type clip.

The at least one releasable attaching, connecting or retentive engaging means is adapted to attach, connect or retentively engage a part of the gabion to the retaining means when the gabion is folded but to release the gabion from the retaining means when the gabion is deployed. As has been seen, the retaining means of the container may be designed so that the releasable attaching, connecting or retentive engaging means is provided by the gabion itself, or by a section thereof. In this sense the attaching, connecting or retentive engaging means is releasable in the sense that it is capable of being released from the retaining means. In other embodiments the attaching, connecting or retentive engaging means may also or instead be releasable from the gabion itself.

The releasable attaching, connecting or retentive engaging means is preferably adapted to break (where it is frangible), disconnect (where it is a clip), or deform (where it is deformable) at a predetermined load, or to break or deform the retaining means of the container at a predetermined load. The predetermined load may be selected to correspond substantially with the weight of a part of the gabion. In one possible embodiment of the invention, the releasable attaching, connecting or retentive engaging means is adapted to break and/or release a part of the gabion when loaded by the weight of a part of the gabion and an additional force (e.g., hand or machine-assisted pulling).

With respect to the drawings, FIG. 1 shows a schematic view of a prior art single unit gabion 10, which comprises a pair of spaced-apart end walls 12 that are hingedly 14 connected to side walls. The side walls comprise two panels each 16 and 18 that are hingedly connected to one another 20 as well as to the end walls 14. Alternative gabion designs suitable for use with the present invention comprise single-panel side walls. Side walls comprising more than two panels are also contemplated within the scope of the invention. Each wall 12, 16 & 18 is constructed from a wire mesh. The hinge connections 14 & 20 are typically helical wire members that engage corresponding edge wires of adjacent walls 12, 16 & 18. The hinges 14 & 20 are sometimes separable from the walls 12, 16 & 18 (for which see our previous application GB0424321.8). Different configurations are possible, such as providing side walls constructed from substantially closed panels rather than mesh panels.

With respect to FIGS. 2 and 4, a prior art multiple-unit gabion is shown 22. The construction is similar to that shown in FIG. 1, with side walls 16 & 18 and an end wall 12 constituting a repeat unit that can be added as many times as necessary to produce a gabion 22 of desired length.

The gabion 22 can be stored in a folded configuration (FIG. 2) and extended to a deployed configuration (FIG. 3) by applying a tensile force as indicated by Arrows A. Conversely, the gabion 22 can be folded by applying a compressive force in the opposite sense to Arrows A.

Once deployed, a gabion can be filled with any suitable material (e.g., rocks, sad, earth, ice, etc.) to produce a wall-type structure. Gabions generally have a liner (not shown) made of a sheet material to inhibit egress of filling material through the holes in the mesh.

In FIGS. 4, 5, 6 and 7, a gabion 22 is represented by showing only a succession of end walls 12 for clarity. The side walls are represented by dotted lines, which show that the end walls 12 are attached, connected to one another.

One convenient way of transporting gabions 22 is in containers as illustrated by FIG. 4. A container 30 generally comprises a base 32, side and end walls 34 and a roof 36. The base 32 has aperture tabs 38 that engage with pins 40 provided (in this case) on a lorry 42. The container 30 has eyelets 44 to enable it to be loaded onto and off the lorry 42 using a crane (not shown).

The gabion 22 is deployed by pulling on the first end wall 12' as indicated by Arrow B such that the gabion extends, usually in a unit-by-unit manner. The pull B can be effected by pulling on the end wall 12', holding the end wall 12' and driving the lorry in the direction indicated by Arrow C or a combination of both.

A major problem with transporting and deploying gabions 22 in this manner is that when the gabion 22 is to be deployed on inclined ground 46, there is a tendency for the gabion 22 to topple out of the container 30. Because the various parts of the gabion 22 are attached, connected to one another 48, once it has begun toppling, a large part, if not all of the gabion 22, is likely to spill out onto the ground behind the lorry 42. This can be extremely hazardous to persons nearby. A further problem is that the gabion 22 can become tangled or break, which can be inefficient, wasteful, and time-consuming to rectify.

Various versions of the invention are illustrated in FIGS. 5 to 13 of the drawings.

Figure 5C:
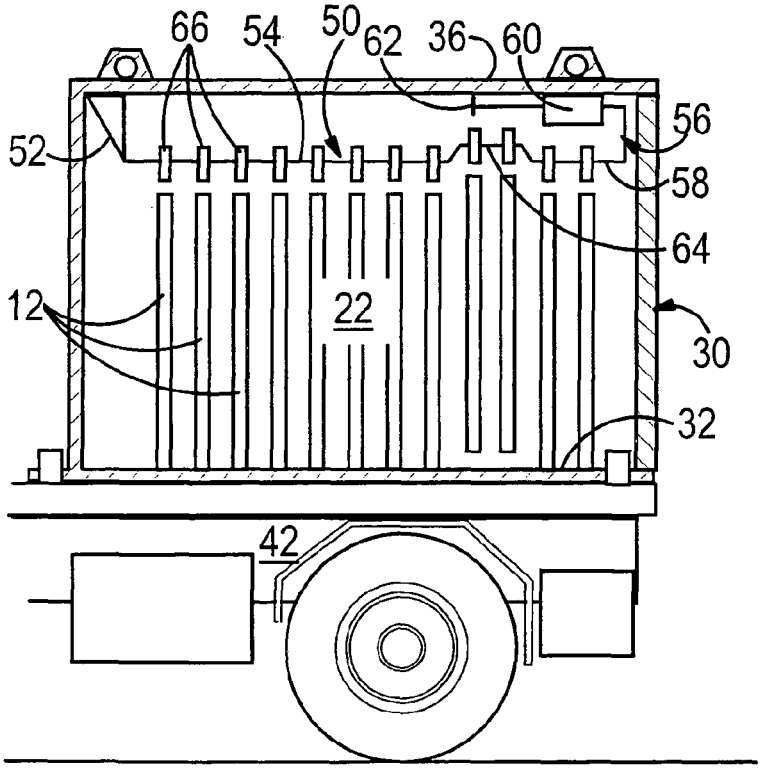
FIGS. 5*a*, 5*b*, and 5*c* show schematic container gabion deployment systems according to the invention.
Figure 5A:
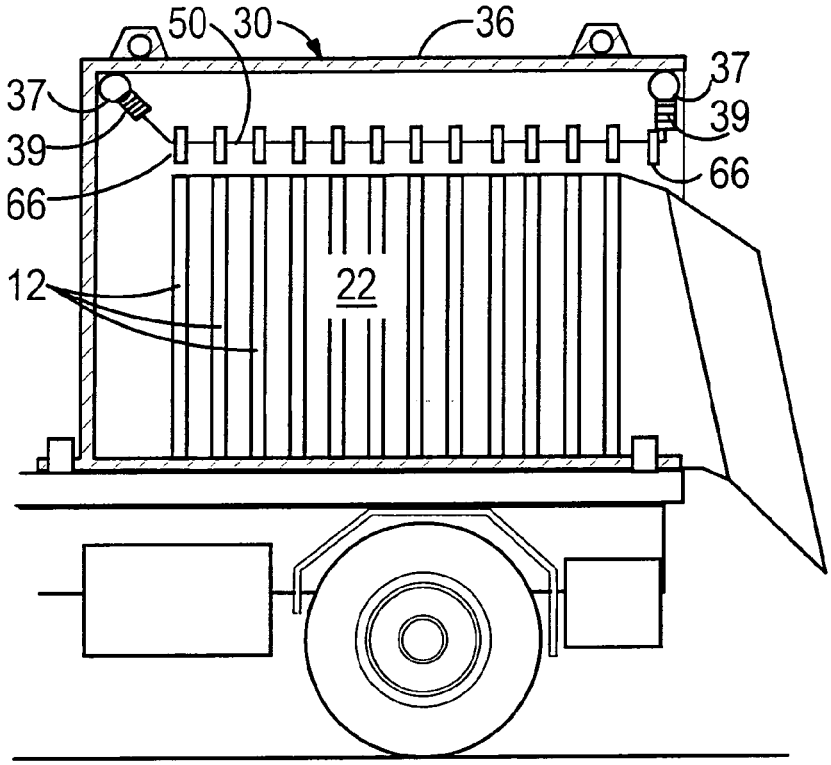
Figure 5B:
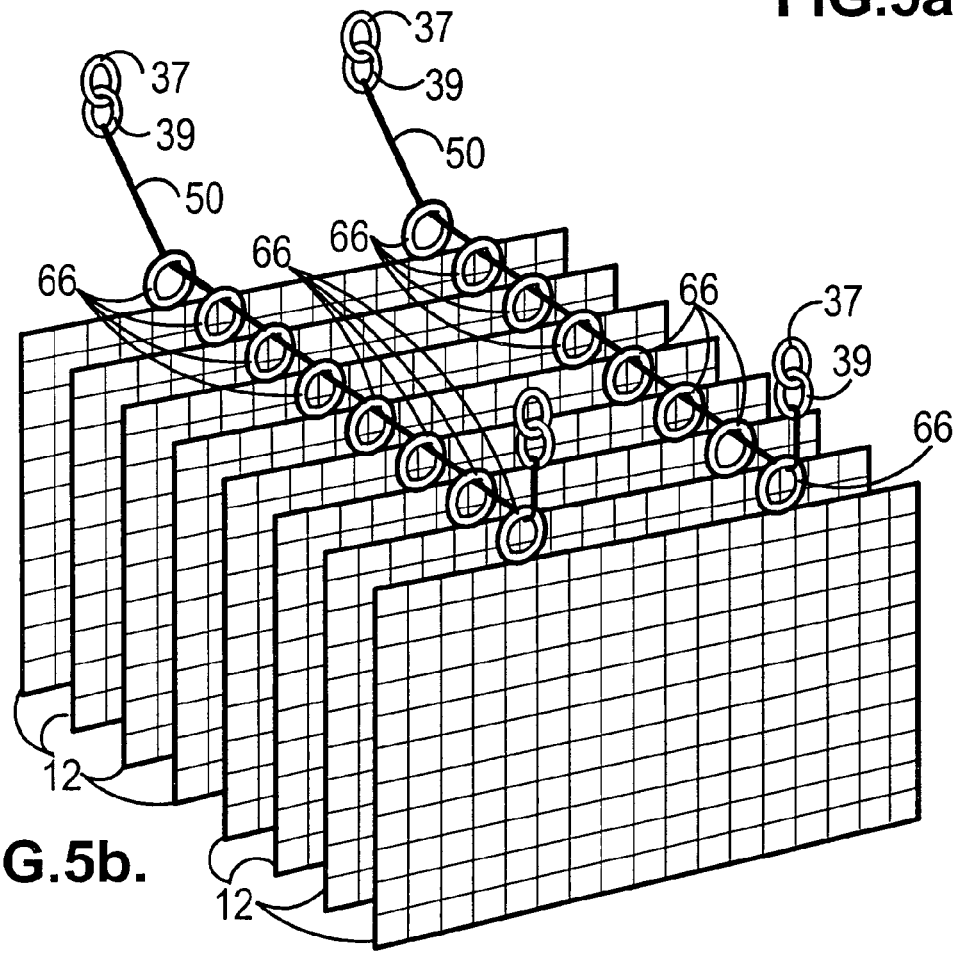

A preferred embodiment of the invention is shown in FIGS. 5*a* to 5*c*. In FIG. 5*a*, a container 30 is shown having a roof 36. From opposite ends of the underside of the roof 36 depend eyelets 37 to which a retaining means in the form of a retaining cable 50 is attached, connected by way of snap hooks 39. End walls 12 of the gabion 22 are attached, connected to the retaining cable 50 by way of discontinuous rings 66.

The retaining cable 50 prevents the gabion 22 from spilling out of the container 30 without the attaching, connecting or retentive engaging rings 66 first being broken or deformed.

In FIG. 5*b* it can be seen that each end wall is provided with a pair of attaching, connecting or retentive engaging rings 66 for attaching, connecting or retentive engaging to a pair of spaced-apart and substantially parallel retaining cables 50.

It is possible to provide non-parallel support cables 50 such that the gabion 22 becomes more difficult to slide therealong as it approaches the door of the container 30.

It is envisaged that the gabion 22 will be factory-assembled, provided with attaching, connecting or retentive engaging rings 66 and folded. One or more support cables 50 could then be threaded through the attaching, connecting or retentive engaging rings 66 and clip fasteners 39 attached, connected or retentively engaged to ends of the cable or cables 50. The gabion 22 could then be loaded into a container 30 and the clip fasteners 39 attached, connected or retentively engaged to roof eyelets 37.

In FIG. 5*c*, the container 30 has a retaining means 50 disposed on the underside of the roof 36. The retaining means comprises an attachment 52 to which a retaining cable 54 is attached, connected or retentively engaged. An extendible/retractable attachment 56 is attached, connected or retentively engaged to the other end of the retaining cable 54. The extendible/retractable attachment 56 comprises a support bar 58 that is slidably engageable with a sheath 60. An end-stop 62 is provided to prevent the support bar from sliding beyond a desired extent. The support bar 58 depends from the sheath 60 and has an undulation 64 therein to inhibit movement of the gabion 22 therealong.

Associated with each end wall 12 of the gabion 22 is a releasable attaching, connecting or retentive engaging means 66 that connects respective end walls 12 of the gabion 22 to either the retaining cable 54 or the support bar 58. The height of the retaining cable 54 and support bar 58 is such that the majority of the weight of the gabion 22 is supported by the floor of the container.

Figure 6:
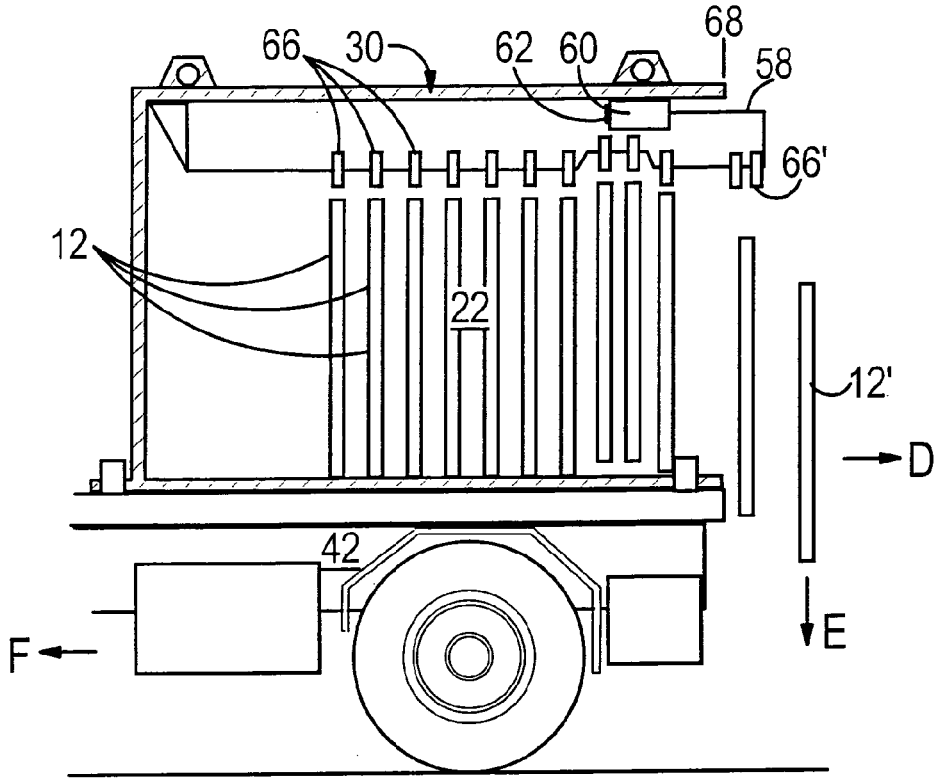
FIG. 6 shows schematic container gabion deployment systems according to the invention.

In use, as illustrated by FIG. 6, the door of the container 30 is opened and the first end wall 12' of the gabion 22 pulled in the direction indicated by Arrow D. The support bar 58 slides beyond the periphery 68 of the container 30 such that a part of the gabion 22 is suspended beyond the periphery 68. The support bar 58 is prevented from disengaging the sheath 60 by virtue of the end-stop 62.

The releasable attaching, connecting or retentive engaging means 66 can be configured to disconnect 66' under the weight of a part of the gabion or to disconnect when an additional force E is applied thereto. Thus, the gabion 22 can be deployed unit-by-unit by a user (not shown) by first pulling a desired number of units out D, then pulling down E to release a desired number of units of the gabion 22. If the releasable attaching, connecting or retentive engaging means 66 are configured to disconnect under just the weight of the gabion 22, then the user need only pull the first unit out D and the rest will follow if the lorry 42 is advanced F.

Figure 7:
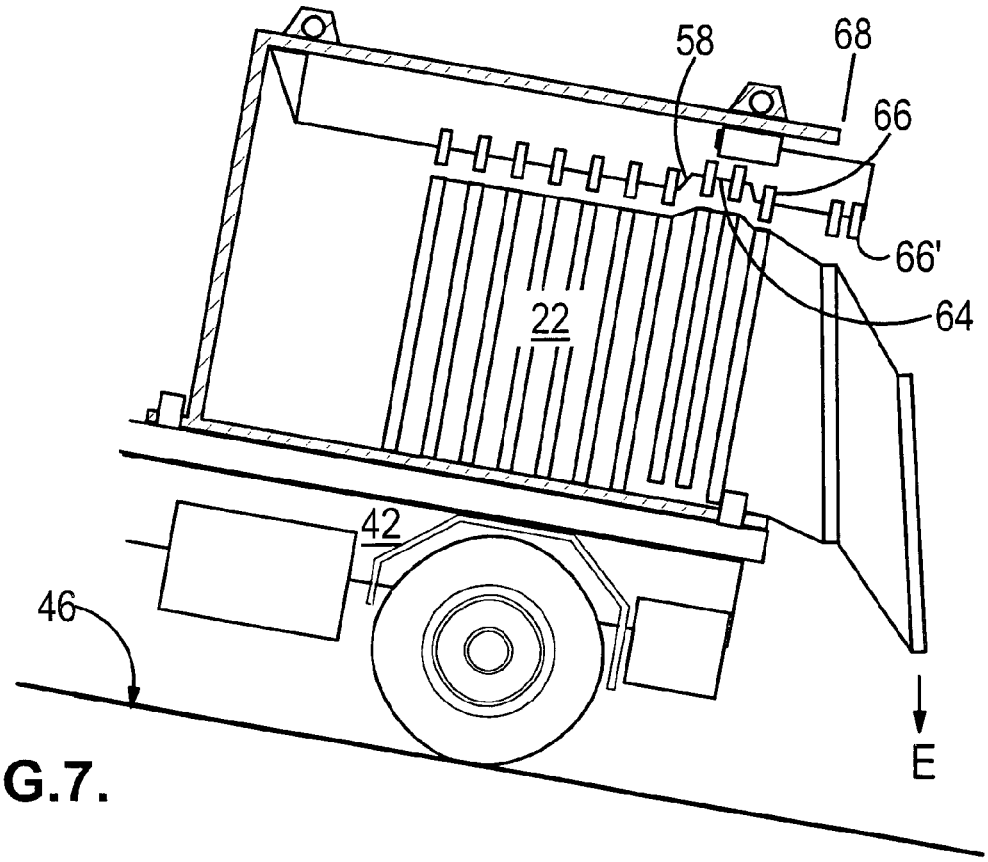
FIG. 7 shows schematic container gabion deployment systems according to the invention.

FIG. 7 shows how the gabion neither deploys nor spills out of the container 30 when the lorry 42 is on inclined ground 46. The releasable attaching, connecting or retentive engaging means 66 are configured to support the weight of the gabion 22 thereby preventing it from spilling out unless an additional force E is applied. Furthermore, the undulation 64 in the support bar 58 limits the number of gabion units that advance beyond the periphery of the container 30, thereby limiting the load on the releasable attaching, connecting or retentive engaging means 66 to prevent additional forces E from being applied thereto.

An alternative embodiment of the invention sees the retaining means dispensing with the attachment 52 and extendible/retractable attachment 56, and having only a retaining cable 54. A pulley/spring/tensioning mechanism may be associated with the retaining cable to maintain it at a desired tension.

Turning now to FIGS. 8 to 11, various possible types of releasable attaching, connecting or retentive engaging means 66 are shown.

Figure 8:
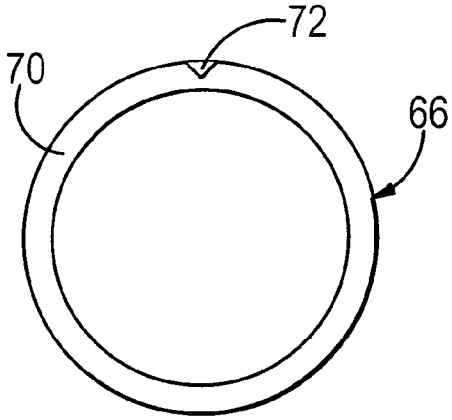
FIG. 8 show side views of ring-type releasable attaching, connecting or retentive engaging means.

In FIG. 8, the releasable attaching, connecting or retentive engaging means 66 comprises a metal ring 70 having a notch 72 therein. The notch is configured such that it causes the ring 70 to break when a predetermined hoop-stress therein is attained.

Figure 9:
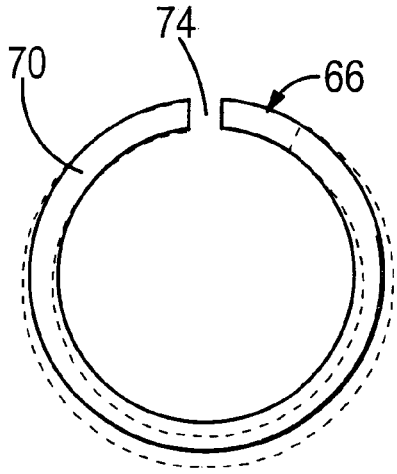
FIG. 9 shows side views of ring-type releasable attaching, connecting or retentive engaging means.

In FIG. 9, a metal ring 70 is shown having a discontinuity 74 therein. Upon application of a force, the ring 70 deforms and the discontinuity 74 enlarges (as indicated by the dotted line) causing the gabion to be released from the retaining means.

Figure 10:
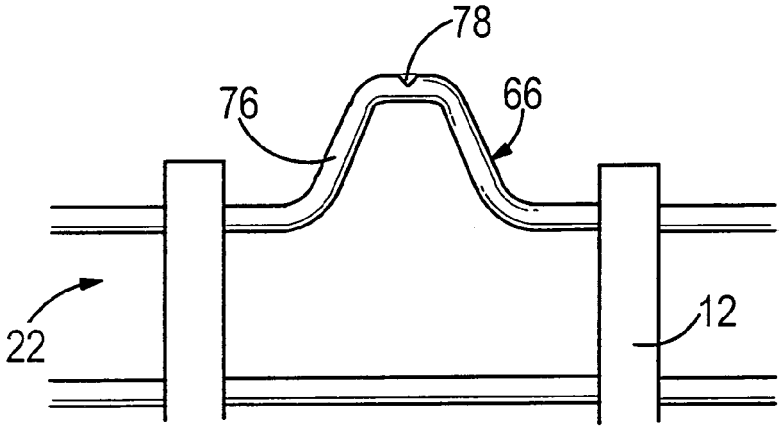
FIG. 10 shows side views of ring-type releasable attaching, connecting or retentive engaging means.

In FIG. 10, the end wall 12 of the gabion 22 has a loop 76 formed integrally therewith through which a retaining cable or the like can be threaded. The loop 76 has a point of weakness 78 therein (in this case a notch) such that the loop 76 breaks under a predetermined load. The loop 76 could be formed integrally with any part of the gabion 22, such as a side wall 16, 18 or a hinge 14, 20.

Figure 11:
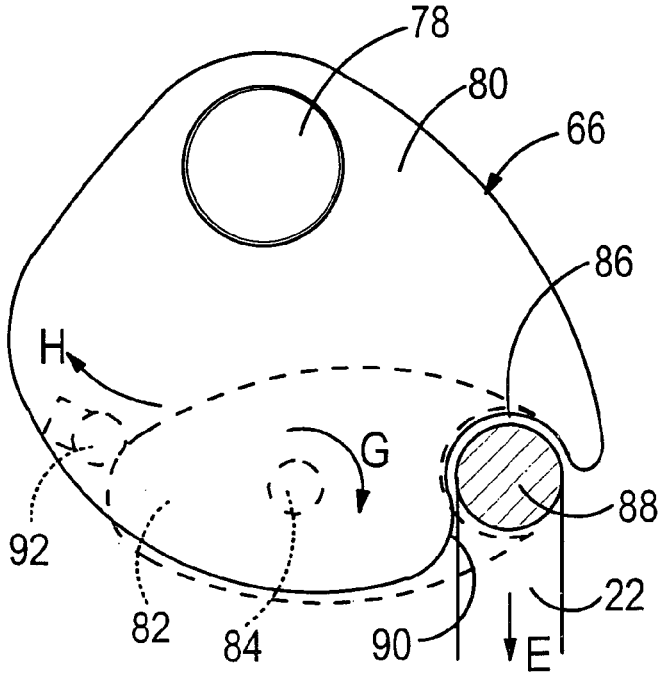
FIG. 11 shows a side view of a clip-type releasable attaching, connecting or retentive engaging means showing certain hidden lines.

FIG. 11 shows a releasable attaching, connecting or retentive engaging means 66 in the form of a camming member. An aperture 78 is provided in the body 80 thereof through which a retaining cable/bar/rod can be threaded. A cam member 82 is provided that is pivotally mounted within the body 80 about a pivot 84. One side of the cam member 82 has a cut-out 86 for receiving a part 88 of a gabion 22. The part 88 of the gabion 22 is retained by the corresponding cam member cut-out 86 and a cut-out 90 in the body 80. The cam member 82 is held in-situ by a sprung ball-bearing 92.

When an excessive load E is applied to the gabion 22, the cam member 82 rotates G and the sprung ball-bearing 92 is depressed H. The cam member 82 eventually over-centres, and the cam member cut-out 86 no longer coincides with the body cut-out 90, thereby releasing the part 88 of the gabion 22. The force E required to cause disconnection of the gabion from the releasable attaching, connecting or retentive engaging means 66 can be configured by adjusting the compressive force applied by the sprung ball-bearing 92 to the cam member 82.

Figure 12:
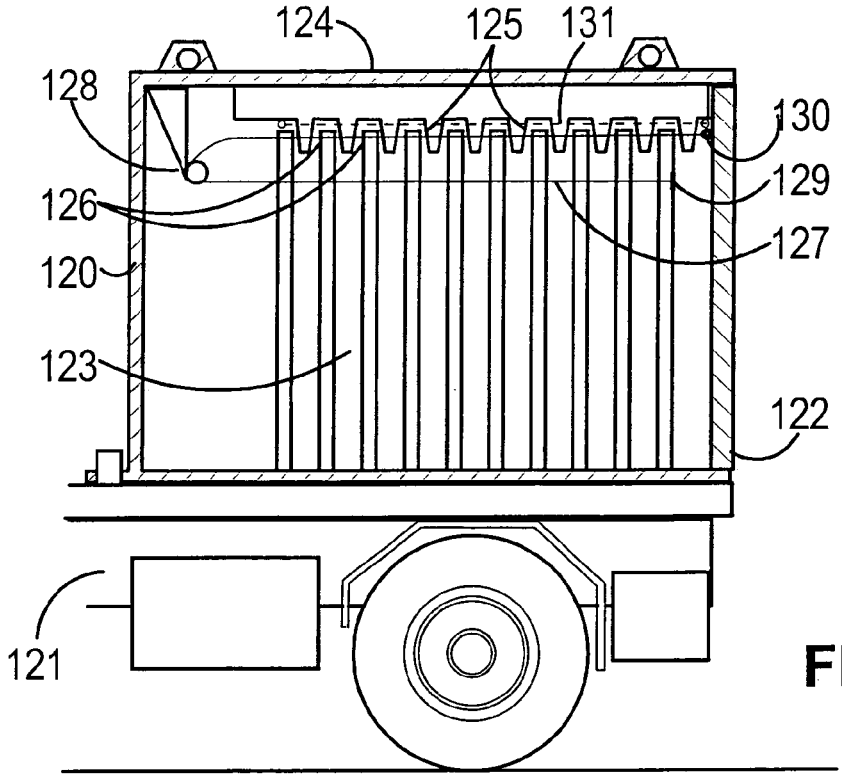
FIG. 12 shows a schematic container gabion deployment system according to the invention.

FIG. 12 shows a gabion deployment system in which a cargo container 120 is mounted on the back of a lorry 121 for transportation purposes. In FIG. 12 the container is in transit and the back doors 122 of the container are closed. Inside the container is stored a multicompartmental gabion 123 of the type described in EP-B-0466726, PCT/GB2006/050367 or PCT/GB2006/050256, for example, or a security barrier of the type described in PCT/GB2007/050450. In the depicted embodiment the multicompartmental gabion or security barrier has ten compartments, each of which (in its folded configuration) is represented by a single line in FIGS. 12 and 13. Although the individual gabion compartments are pivotally interconnected, no such interconnection is shown in the drawings, for simplicity therein.

Mounted on the underside of roof 124 of container 120 is a retaining means comprising a row of protruding teeth 125, each of which in the embodiment shown extends into the region between neighbouring folded gabion compartment edge sections 126, retentively engaging the said sections. Teeth 125 are formed of a material such as rubber having an elastic character so that the teeth are able to flex from side to side. However, in this embodiment there is also provided a guide wire 127 which is threadedly engaged with edge sections 126 and which passes around pulley 128 and back through the individual teeth 125 of the restraining means, by means of suitable orifices (not shown) provided in the said teeth, or each of them. The guide wire is secured at one end to first gabion compartment 129, and at its opposite end is provided with a bulbous portion 130 which can only be passed through the guide line orifice of an individual tooth 125 on the application of some considerable force, of the order which would result from the first gabion compartment being pulled (usually by mechanical means) from the container once the doors are opened.

The retaining means may additionally be provided with a stiffening rod passing through a second set of orifices in the tooth members and serving to limit the possible flexural movement of teeth 125 to provide extra strength and stability to the retaining means, and enhancing its retentive effect on the folded gabion compartment edge sections. The stiffening rod is indicated by dotted line 131 in FIGS. 12 and 13, and is optionally provided.

Figure 13:
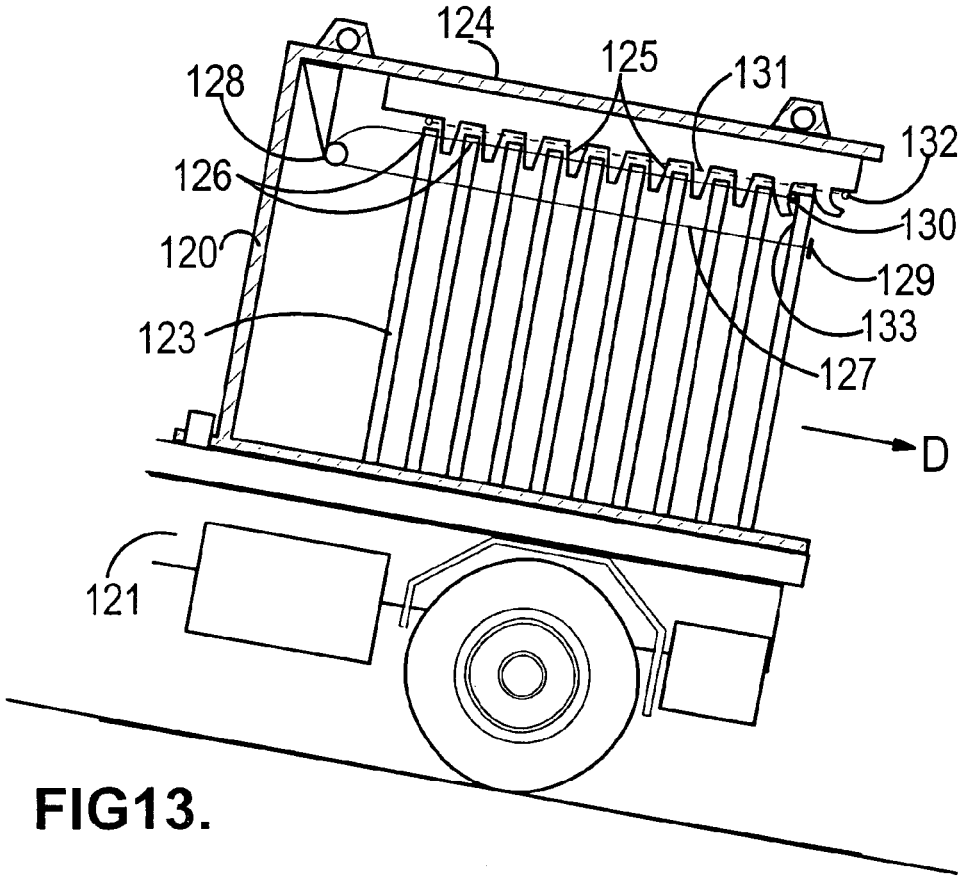
FIG. 13 shows a schematic container gabion deployment system according to the invention.

As shown in FIG. 13, when the container doors are opened the first gabion compartment may be pulled (by means of a tow truck, for example, or manually) in the direction indicated by arrow D. Guide wire 127 is pulled at the same time and bulbous portion 130 is forced through the orifice of the first tooth 132. First folded gabion compartment edge section 133 then bears against tooth 132 causing it to flex and release the first compartment from the container. Continued towing causes repetition of this process in relation to the second and subsequent compartments, allowing the gabion to be deployed quickly but safely, even on an incline as shown in FIG. 13.

The invention claimed is:

1. A container suitable for storing a folded gabion cage and from which the gabion cage can be deployed, the container comprising:

a plurality of side walls, a roof, and a mechanical restrainer disposed on one of the plurality of side walls or the roof, wherein a folded gabion cage can be releasably attached to the mechanical restrainer and stored in an interior space defined by the plurality of side walls and the roof, and wherein the mechanical restrainer releases the gabion cage at a predetermined load.

2. The container of claim 1, having a size suitable for loading onto a ship and/or vehicular trailer.

3. The container of claim 1, wherein the mechanical restrainer is attached to the roof.

4. The container of claim 1, wherein the mechanical restrainer comprises one or more hooks, one or more eyes, or one or more tooth-like protuberances, wherein said tooth-like protuberances comprise a gap between two protuberances accommodating in use of the stored gabion cage the edge section of one or more folded compartments of the gabion.

5. The container of claim 1, wherein the mechanical restrainer comprises a plurality of hooks or eyes, and a bar, rod or cable.

6. The container of claim 5, wherein the mechanical restrainer extends along substantially the entire length of the container.

7. The container of claim 5, wherein the mechanical restrainer is retractably extendable beyond a periphery of the container.

8. A foldable gabion cage comprising:

two end walls;

a plurality of pivotally connected sidewalls; and at least one connector releasably connecting an end wall or a sidewall to a mechanical restrainer of a container, and releasing the gabion cage from the container at a predetermined load, wherein the gabion cage can be folded and stored in the container.

9. The foldable gabion cage of claim 8, wherein the connector has a point of weakness to encourage the connector to break at a predetermined position and/or load.

10. The foldable gabion cage of claim 9, wherein the predetermined load corresponds substantially with the weight of a part of the gabion cage or with a towing force applied to the gabion cage.

11. The foldable gabion cage of claim 8, further comprising one or more compartment walls between the two end walls.

12. The foldable gabion cage of claim 8, wherein the end walls and sidewalls are constructed from a wire mesh.

13. The foldable gabion cage of claim 8, wherein the sidewalls are pivotally connected by helical wire hinges.

14. A gabion cage deployment system comprising:

a container having a plurality of side walls, a roof and a mechanical restrainer disposed on one of the plurality of side walls or the roof; and a foldable gabion cage having two end walls, a plurality of pivotally connected sidewalls, and at least one connector releasably connecting an end wall or a sidewall to the mechanical restrainer of the container and releasing the gabion cage from the container at a predetermined position and/or load, wherein the gabion can be folded and stored in the container.

15. The gabion cage deployment system of claim 14, wherein the mechanical restrainer is attached to the roof of the container.

16. The gabion cage deployment system of claim 14, wherein the mechanical restrainer comprises a bar, rod or cable, and wherein the connector comprises one or more hooks or eyes.

17. The gabion cage deployment system of claim 14, wherein the connector has a point of weakness to encourage the connector to break at the predetermined position and/or load.

18. The gabion cage deployment system of claim 17, wherein the predetermined load corresponds substantially with the weight of a part of the gabion cage or with a towing force applied to the gabion cage.

19. The gabion cage deployment system of claim 14, wherein the gabion cage further comprising one or more compartment walls between the two end walls.

20. The gabion cage deployment system of claim 14, wherein the end walls and sidewalls are constructed from a wire mesh.

* * * * *